US008723680B1

(12) United States Patent
Baker

(10) Patent No.: US 8,723,680 B1
(45) Date of Patent: May 13, 2014

(54) EMERGENCY RESPONDENCE WARNING SYSTEM

(76) Inventor: Paul Alan Baker, Tulsa, OK (US)

( * ) Notice: Subject to any disclaimer, the term of this patent is extended or adjusted under 35 U.S.C. 154(b) by 269 days.

(21) Appl. No.: 13/227,723

(22) Filed: Sep. 8, 2011

(51) Int. Cl.
*G08B 21/00* (2006.01)
*G08G 1/00* (2006.01)
*G08B 1/08* (2006.01)

(52) U.S. Cl.
USPC ..... 340/686.6; 340/539.1; 340/686.1; 340/902

(58) Field of Classification Search
USPC ..... 340/902–907
See application file for complete search history.

(56) References Cited

U.S. PATENT DOCUMENTS

| | | | | |
|---|---|---|---|---|
| 3,784,970 | A | 1/1974 | Simpkin | |
| 4,017,825 | A | 4/1977 | Pichey | |
| 4,736,186 | A | 4/1988 | Jones | |
| 4,775,865 | A | 10/1988 | Smith et al. | |
| 5,187,476 | A * | 2/1993 | Hamer | 340/906 |
| 6,441,749 | B1 | 8/2002 | Edwards | |
| 6,980,125 | B1 | 12/2005 | Barber | |
| 6,987,464 | B2 | 1/2006 | Pearson | |
| 7,019,669 | B1 | 3/2006 | Carr | |
| 7,471,213 | B2 | 12/2008 | Ellison | |
| 2008/0094249 | A1 * | 4/2008 | Pappas et al. | 340/906 |
| 2010/0013669 | A1 * | 1/2010 | Tanaka | 340/905 |
| 2011/0187559 | A1 * | 8/2011 | Applebaum | 340/907 |

FOREIGN PATENT DOCUMENTS

| | | |
|---|---|---|
| CA | 1252841 | 4/1989 |
| JP | 2005100097 | 4/2005 |
| JP | 2008052341 | 3/2008 |
| WO | 2005094544 | 10/2005 |
| WO | 2008049095 | 4/2008 |

* cited by examiner

*Primary Examiner* — Steven Lim
*Assistant Examiner* — Omeed Alizada
(74) *Attorney, Agent, or Firm* — Millikin Intellectual Property Law; Margaret S. Millikin

(57) ABSTRACT

An emergency respondence warning system for warning of the approach of emergency vehicles at roadway intersections. The warning system comprises a transmitter mountable to an emergency vehicle and a receiver situated near the roadway intersection. As the emergency vehicle approaches the intersection, the transmitter sends signals to the receiver, which are processed by the receiver when the vehicle is within a predetermined distance. The receiver activates a distinct visual warning signal alerting nearby drivers and pedestrians of the approach of an emergency vehicle. The emergency respondence warning system also warns of the approach of multiple emergency vehicles. When the receiver determines that two emergency vehicles are approaching the intersection, it activates the warning element but triggers a dedicated visual signal indicating the approach of multiple vehicles.

23 Claims, 10 Drawing Sheets

20

PROCESS

EMERGENCY RESPONDENCE WARNING SYSTEM

TECHNICAL FIELD OF THE INVENTION

The present invention relates generally to emergency respondence warning systems and, more particularly, to emergency vehicle visual warning systems for alerting persons and vehicles near an intersection that an emergency vehicle is approaching. A method of alerting persons and vehicles near an intersection of the approach of an emergency vehicle is also provided.

SUMMARY OF THE INVENTION

The present invention is directed to an emergency respondence warning system, comprising a transmitter mountable to an emergency vehicle, the transmitter comprising a global positioning chip and capable of producing a signal. The emergency respondence warning system also comprises a receiver mountable near a roadway intersection, the receiver comprising a global positioning chip, wherein the receiver is capable of analyzing the signal from the transmitter as the transmitter approaches the receiver and, when the transmitter reaches a pre-determined distance from the receiver, of activating the warning system. The emergency respondence warning system also comprises a warning element comprising a visual light stimulus, the warning element mountable near the roadway intersection and adapted to produce a single light pulse when a single transmitter is approaching the roadway intersection and multiple light pulses when multiple transmitters are approaching the roadway intersection.

The present invention further is directed to a method of warning of the approach of emergency vehicles at a roadway intersection. The method comprises the steps of transmitting a signal from an approaching emergency vehicle to a receiver comprising a global positioning chip, the receiver mountable near the roadway intersection; analyzing the signal to determine whether the transmitter is traveling toward the receiver and whether the transmitter emergency vehicle is within a predetermined distance from the receiver and with respect to any direction of travel thereto; analyzing the signal to determine whether the emergency vehicle is traveling toward the receiver; and activating a warning element when the transmitter reaches a pre-determined distance from the receiver by producing a single pulse of light when a single transmitter is approaching the roadway intersection and multiple pulses of light when multiple transmitters are approaching the roadway intersection.

DETAILED DESCRIPTION OF THE INVENTION

Figure 1:
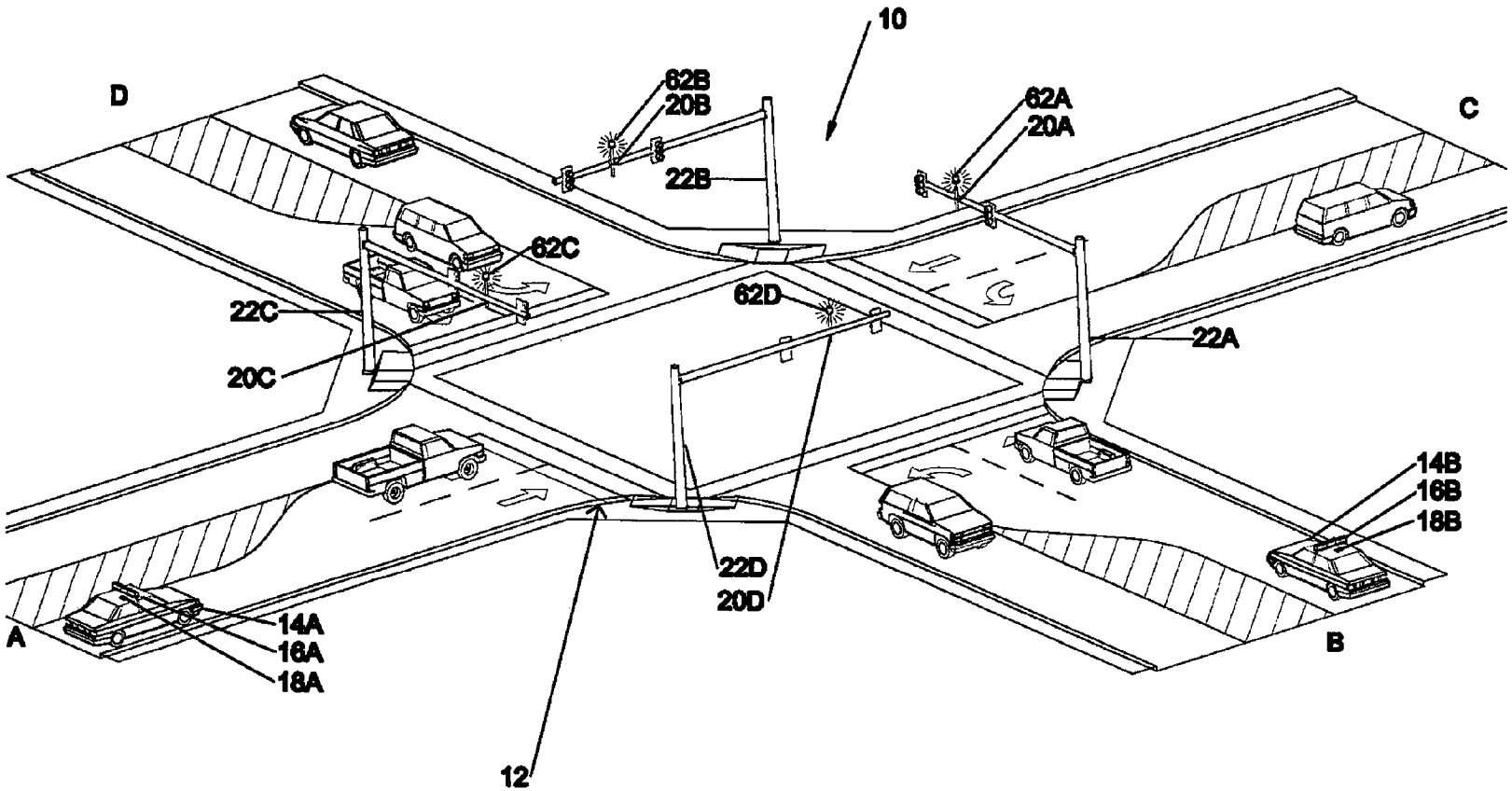
FIG. 1 illustrates a roadway intersection equipped with an embodiment of the emergency respondence warning system of the present invention.

Public servants, such as police, fire fighters, and ambulance personnel, as well as other private entity emergency responders, routinely are called to service situations requiring immediate response. Responders undertake considerable risk, even before arriving at the scene, in driving at high speeds to answer a call as quickly as possible. These situations are inherently dangerous and involve serious risk of collision, not only to emergency personnel and their passengers, but also to other vehicles, pedestrians and bystanders.

Municipalities, hospitals and other managing authorities employ the use of audio and visual warning systems to alert the public of the approach of an emergency vehicle. For example, fire engines are painted red, and police cars are marked with black and white paint to signal the approach of an official emergency vehicle. Additionally, emergency lights and sirens are employed to alert traffic of the approach of crisis responders and warn them to permit ingress of responders through intersections. Despite these warning methods, numerous collisions with emergency vehicles occur annually, resulting in personal injury to emergency personnel, their passengers and nearby drivers and pedestrians, as well as property damage in the vicinity.

Studies suggest that collisions with crisis responders during calls are more often than not attributable to pedestrians and drivers near an intersection who fail to perceive the approach of an oncoming emergency vehicle. Data from these studies shows that emergency vehicles are more likely to be struck by another vehicle whose driver was unaware of the approach of an emergency responder. Consequently, warning systems tend to focus on methods of warning drivers, rather than emergency responders, of the approach of emergency vehicles to minimize the number of collisions with crisis responders.

Visual warning systems have proven to be the most effective in alerting drivers and pedestrians of the approach of emergency vehicles at roadway intersections. Motor vehicle drivers rely primarily on their sense of vision when operating a vehicle. Aural senses are used secondarily. Accordingly, visual warning systems tend to carry the most impact on drivers in operation of their vehicles and, consequently, of the approach of emergency vehicles at crossroads.

Some conventional visual warning systems permit the emergency responder to control the color of the traffic light at the intersection via control means within the response vehicle. With these systems, emergency responders may control the traffic light and ensure that it is green in the direction from which the responder advances. Such systems do not alert others of the crisis responder's approach, however.

Other systems provide a central master control computer at a remote location that receives information from a transmitter within the emergency vehicle. The master control sends warning information to a display at a roadway crossing in the path of the crisis responder. The display warns advancing vehicles and pedestrians of the approach of the emergency vehicle. Such systems are costly and are susceptible to system-wide maintenance issues and shut-downs.

It is apparent that there is a need for a simplified visual emergency respondence warning system that is separate from and operated independently of a central controller and that provides visual stimuli for other drivers and pedestrians. The present invention overcomes difficulties associated with conventional emergency respondence warning systems and provides an efficient and cost effective method for alerting others of the approach of emergency vehicles. These and other advantages of the present invention will be apparent from the following description of the preferred embodiments.

Turning now to the drawings in general, and to FIG. 1 in particular, there is shown therein an example of an emergency respondence warning system 10 of the present invention situated at a roadway intersection 12. The emergency respondence warning system 10 may be used with any type of emergency vehicle, including, without limitation, police, fire, and ambulance vehicles, and in both civilian and military settings. By way of example, FIG. 1 illustrates a police car as the emergency vehicle 14A that is operating an embodiment of the emergency respondence warning system 10 of the present invention. The emergency vehicle 14A may be equipped with a lighting bar 16A powered by the electrical system of the vehicle.

The emergency respondence warning system 10 comprises a transmitter 18A capable of transmitting a signal and a receiver 20A capable of receiving and analyzing a signal from the transmitter. The transmitter 18A is adapted to send a signal identifying certain data regarding the emergency vehicle 14A as further described herein, such as speed, direction and distance of the emergency vehicle.

The transmitter 18A may be connected with the vehicle 14A by any suitable means, such as being mounted to the roof or to the light bar of the emergency vehicle. In one embodiment of the invention, the transmitter 18A may be mounted to the light bar 16A of the emergency responder's vehicle 14A and powered by the vehicle's electrical system. It will be appreciated that the transmitter 18A need not be permanently or even temporarily affixed to the vehicle 14A. For example, the transmitter 18A may be loosely situated within the interior of the vehicle 14A and remain unaffixed to any permanent object on or in the vehicle. This enables the operator of the emergency vehicle 14A to move the transmitter 18A for various reasons and advantages, including moving it from one vehicle to another or placing it out of sight in an unmarked vehicle.

Figure 2:
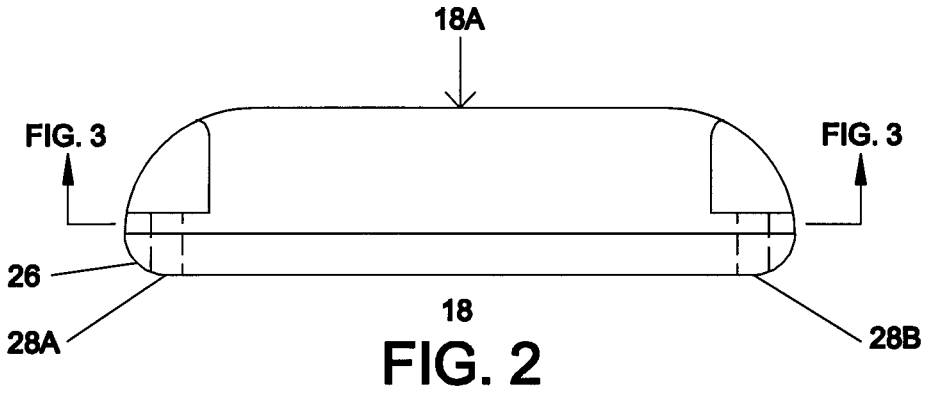
FIG. 2 illustrates a side view of the housing for a transmitter comprising the emergency respondence warning system of the present invention.
Figure 3:
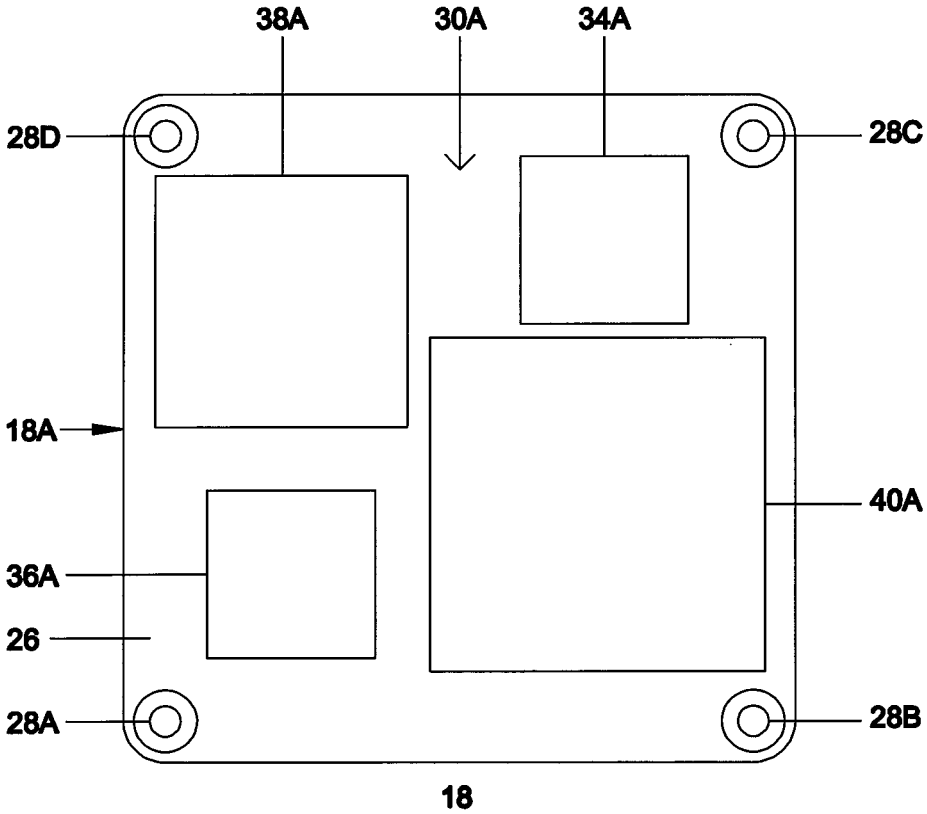
FIG. 3 illustrates a cross-sectional plan view of the transmitter of FIG. 2 and shows a sample arrangement of electrical and physical components comprising a transmitter of the emergency respondence warning system of the present invention.

Turning now to FIGS. 2 and 3, the transmitter 18A preferably comprises a housing 26 and mounting apertures 28A, 28B, 28C and 28D. The housing 26 may be comprised of a weather resistant material, such as plastic or metal, and be of a water-proof construction. The apertures 28A, 28B, 28C and 28D in housing 26 receive screws, bolts or other connectors for attaching the transmitter 18A to a conventional mounting assembly or bracket, not shown, thus securing the transmitter to the light bar 16A or other part of the vehicle 14A. In one embodiment, the transmitter 18A may be hardwired into the power source for the lighting bar 16A. Alternatively, when the transmitter 18A is loose in the vehicle 14A, it may be plugged into the electrical system for the vehicle through the cigarette lighter with an electrical cord and adapter, not shown. It will be appreciated that the transmitter 18A may be powered by any suitable means, including solar power or battery.

With continuing reference to FIG. 3, the mechanism by which the transmitter 18A sends a signal will be described. In one embodiment of the invention, the transmitter 18A comprises a global positioning system (GPS) and radio frequency (RF) tracking system 30A comprised of a GPS chip 34A, an RF chip 36A, a processor 38A and a battery 40A. Whenever the power source to the transmitter 18A is turned on, the RF-GPS tracking system continuously or intermittently sends signals broadcasting the position information of the vehicle 14A, such as distance traveled, length of time traveled, current speed, average speed, path of travel and estimated time of arrival at destination, if current speed is maintained. Examples of GPS-RF tracking systems 30A suitable for use in the present invention include Sparkfun Electronics model number GPS-08975 employing MediaTek GPS chip technology and Digi International/Maxstream RF chip number SBP24-AUI-001. Spy Chest manufactures a joint GPS-RF system, model number SCI-GPSRF, suitable for use in the present invention. Motorola, Intermec, Impinj and Sirit manufacture RF or GPS chips suitable for use in the present invention.

The processor 38A runs software which is generally known in the industry and that operates the GPS chip 34A and RF chip 36A. When the transmitter 18A is activated, it will receive information from the GPS-RF system 30 and transmit the vehicle 14A location information to the receiver 20A at a rate of several times per second. The signals from the transmitter 18A are detected and processed by the receiver 20A in a manner yet to be described.

Returning to FIG. 1, the receiver 20A of the emergency respondence warning system 10 is situated near the roadway intersection 12. The receiver 20A is capable of receiving and analyzing a signal from the transmitter 18A to determine various properties of the approaching emergency vehicle 14A. Receiver 20A preferably is situated near the roadway intersection such that the receiver can be viewed by drivers, pedestrians and operators of other vehicles when they are near or in the intersection. In one embodiment of the invention, the receiver 20A is mounted to the traffic light pole 22A at intersection 12. It is not necessary that the receiver 20A mounted near the intersection 12 interact with the traffic signals at the intersection. The receiver of the present invention works independently of any traffic signal changes and operations.

Figures 4A, 4B, 4C:
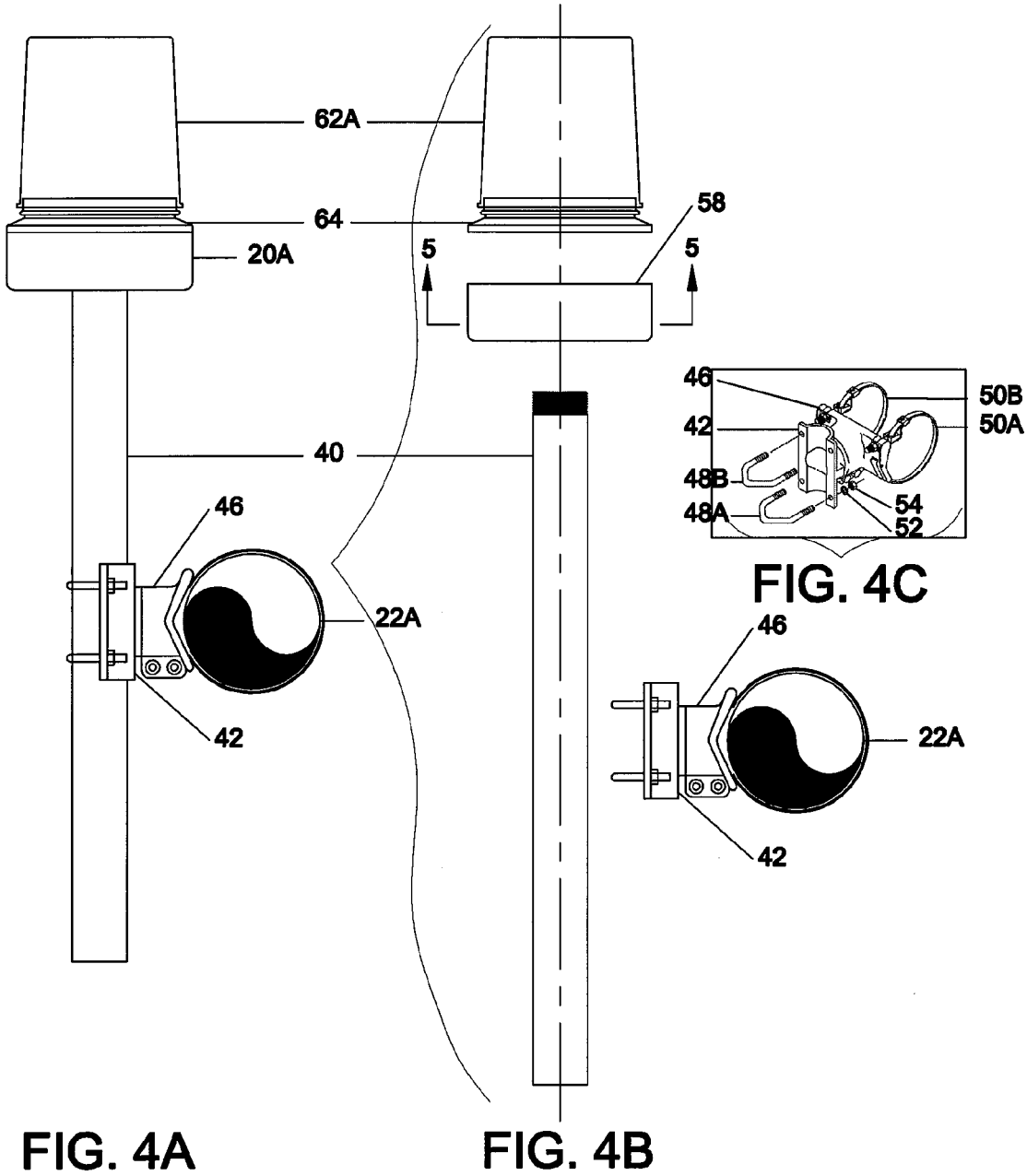
FIG. 4A illustrates examples of a receiver, warning element and mounting hardware comprising the emergency respondence warning system of the present invention.
FIG. 4B illustrates an exploded view of the receiver, warning element and mounting hardware in FIG. 4A.
FIG. 4C illustrates a sample mounting assembly for mounting a receiver of the present invention to a light pole.

Turning now to FIGS. 4A, 4B and 4C, in one embodiment of the invention, the receiver 20A is supported by a pipe 40 or other support member, which is mountable on light pole 22A, shown in cross-section, by mounting assembly 42. The support 40 for receiver 22A may be made of any suitable material, including aluminum, stainless steel, polyvinylchloride or metal alloys. Examples of suitable mounting assemblies 42 include those provided by PELCO Products, Inc., such as band mount clamp kit number AB-3004-L and cable hanger number SE-3019. The mounting assembly 42 shown in FIGS. 4A, 4B and 4C includes a brace 46, U-bolts 48A and 48B for securing the brace to the support 40 for the receiver 20A, straps 50A and 50B for securing the brace to the light pole 22A, and nuts 52 and screws 54 for connecting the mounting assembly together with the support 40 and the light pole 22A.

Figure 5:
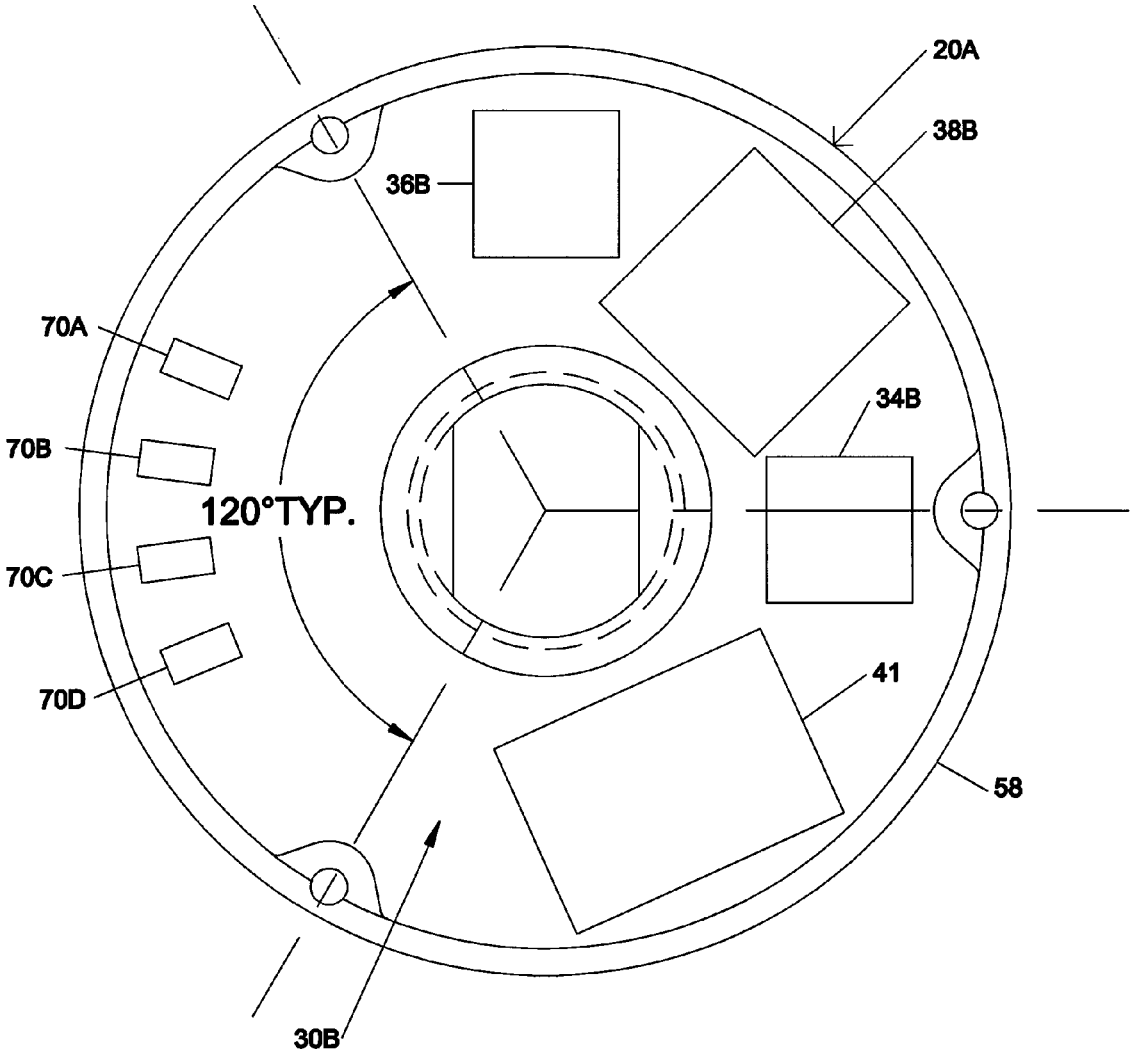
FIG. 5 illustrates a cross-sectional plan view of the receiver of FIG. 4B.

As shown in FIG. 5, and with continuing reference to FIGS. 4A and 4B, the receiver 20A comprises a housing 58 for holding electrical components of the receiver. The housing 58 is water tight and may be constructed of any suitable material, such as plastic or metal, although metal typically is preferred for strength and weather resistance.

The receiver 20A may be powered by a number of means. For example, the receiver 20A may share power with the power source for the light signals at the roadway intersection 12 by being hardwired into the intersection lighting system. Alternatively, the receiver 20A may be powered by an independent source, such a battery and solar power backup. In an alternate embodiment, the receiver 20A may be located on the ground near the intersection, preferably within 250 feet of the intersection, particularly in situations where the intersection does not have an electrical lighting signal. It may also be located on the ground near the intersection, for example, when the intersection does not contain traffic lights and is powered by solar or battery power.

It will now be appreciated that the receiver 20A also comprises a mechanism for receiving, analyzing and processing signals from the transmitter 18A. In one embodiment of the invention, the receiver 20A comprises a global positioning system (GPS) and radio frequency (RF) tracking system 30B comprised of a GPS chip 34B, an RF chip 36B, a processor 38B and a transformer 41. Examples of RF-GPS tracking systems 30B suitable for use in the present invention include Sparkfun Electronics model number GPS-08975 employing MediaTek GPS chip technology and Digi International/Maxstream RF chip number SBP24-AUI-001. Spy Chest manufactures a joint GPS-RF system, model number SCI-GPSRF, suitable for use in the present invention. Motorola, Intermec, Impinj and Sirit manufacture RF or GPS chips suitable for use in the present invention. The transformer 41 converts the voltage from the electric power system powering the intersection to a voltage that can be utilized by the receiver 20A. Transformers suitable for use in the present invention 10 are known in the art.

The processor 38B runs proprietary software that operates the GPS chip 34B and RF chip 36B and is packaged and sold for operation with the chips. The processor 38B communicates with the transmitter 18A in a manner yet to be described.

Returning to FIGS. 2 and 3, whenever the power source to the transmitter 18A is turned on, the RF-GPS tracking system 30A continuously or intermittently sends signals which the receiver 20A interprets as the position information of the vehicle 14A, such as distance traveled, length of time traveled, current speed, average speed, path of travel and estimated time of arrival at destination, if current speed is maintained. When the transmitter 18A is activated, it will send information from the GPS-RF system 30A to the receiver 20A at a rate of several times per second. With that information, the receiver 20A will calculate the speed, distance, and direction of travel of the transmitter 18A and whether the emergency vehicle 14A is within a predetermined distance and traveling towards the receiver. As the emergency vehicle 14A approaches the intersection 12, the transmitter 18A broadcasts its GPS location which is then picked up by the receiver 20A.

The receiver 20A detects and analyzes the broadcast location of transmitter 18A with reference to its own location and determines distance, direction and speed of the vehicle 14A. Receiver 20A may determine a distance and a direction of the emergency vehicle 14A in any direction of travel with respect to the receiver. For example, if emergency vehicle 14A is traveling along path of travel A shown in FIG. 1, transmitter 18A mounted atop vehicle 14A or inside vehicle 14A sends a signal to receiver 20A. Receiver 20A analyzes the signal and determines speed, distance, and direction of travel of the emergency vehicle 14A and whether the vehicle is within a predetermined distance of and traveling towards the receiver.

It will be appreciated that the emergency respondence warning system 10 of the present invention may comprise one receiver 20A or a plurality of receivers. When only one receiver 20A is present at the intersection 12, then the one receiver controls all directions of traffic. FIG. 1 demonstrates a configuration of four receivers 20A, 20B, 20C and 20D, each of which is adapted to determine a distance and a direction of the emergency vehicle 14A in any direction of travel with respect to the receiver analyzing the signal. When multiple receivers are employed at the roadway intersection 12, then all of the receivers 20A-20D respond similarly to the approach of emergency vehicle 14A. The transmitter 18A of vehicle 14A broadcasts signals which are detected by all receivers 20A-20D at the intersection 12, and each receiver processes these signals according to the protocol programmed into the processor 38A.

With continuing reference to FIGS. 1, 4A and 4B, it now will be appreciated that the emergency respondence warning system 10 also comprises a warning element 62A operable in conjunction with the receiver 20A. The warning element 62A provides a visual stimulus or multiple stimuli alerting of the approach of emergency vehicle 14A toward roadway intersection 12. In one embodiment of the invention shown in FIGS. 4A and 4B, the warning element 62A is mechanically fastened, such as by screws, bolts, threads, or clamps, to the housing 58 of the receiver 20A and operates in physical proximity with the receiver or as an integral unit with the receiver. However, the warning element 62A need not be in direct contact with the receiver 20A and may be physically removed from the receiver as long as the receiver is electronically connected to the warning element to receive instructions from the receiver 20A. The warning element 62A preferably is constructed of transparent or translucent materials, such as plastic or glass, to enhance visual stimulation and capture the attention of drivers, passengers and pedestrians near the intersection 12. The warning element 62A is situated near the roadway intersection 12 such that it can be viewed by drivers, pedestrians and operators of other vehicles when they are near or in the intersection. A visual line of sight of the warning element 62A of at least 1600 feet is preferred.

The warning element 62A may comprise a number of alternative visual warnings. For example, a stroboscopic light may serve as a visual warning element for the system 10 of the present invention. Suitable alternatives include rotating incandescent lights or LED beacons. The color of the visual warning element 62A and the light emanating from it may be any color consistent with traffic rules and regulations of the jurisdictions in which the system 10 is used. In one embodiment of the invention, the color of light from the visual warning element 62A is blue since the color blue is not used in traffic engineering for controlling traffic at intersections. It should be borne in mind, however, that the color of the warning element 62A may be dictated by the requirements of the municipality or other controlling jurisdiction where the warning system 10 is employed.

The operation of the emergency respondence warning system 10 now will be described. Transmitter 18A atop vehicle 14A will emit a signal which, when a predetermined distance from the receiver occurs, the GPS-RF system 30B of receiver 20A executes a protocol, analyzes signals from the transmitter and interprets the distance, direction of travel and speed of vehicle 14A, among other things, as hereinbefore described. When the vehicle 14A reaches a predetermined distance from the receiver 20A, the receiver activates the warning element 62A mountable near to the roadway intersection 12. The time in which the warning element 62A will be activated depends upon the speed of travel of the vehicle 14A and the distance from the receiver 20A. The receiver 20A determines the approximate amount of time that will be required for the vehicle 14A to reach the intersection 12. This, in turn, will depend upon the speed of travel of the vehicle 14A and the distance at which the receiver 20A is programmed to respond to the signal from the transmitter 18A. In one embodiment of the invention 10, the receiver 20A will receive a signal from the transmitter 18A when the vehicle 14A is at least within 60 seconds of reaching the receiver. The receiver 18A will activate the warning element 62A when the emergency vehicle 14A is between 10 to 20 seconds away from the receiver, and in one embodiment of the invention the receiver will activate the warning element when the emergency vehicle is about 15 seconds away from the receiver.

The distance at which the receiver 20A will activate the warning element 62A depends upon the conditions at the roadway intersection 12 and, most particularly, the authorized speed limit at the intersection. To that end, the receiver 20A may comprise a plurality of switches or buttons correlating to different speeds common to city, town and highway speed limits. As shown in FIG. 5, buttons or switches 70A, 70B, 70C, and 70D correspond to speed limits, such as 25 mph, 35 mph 45 mph and 55 mph. When installing the emergency respondence warning system 10, the appropriate speed for the intersection 12 is selected, and the processor 38A is programmed to calculate the relevant speed and position of an emergency vehicle with respect to the speed limit at the intersection. When the speed limit at the intersection 10 changes, the appropriate switch 70A-70D is selected for the changed condition.

Returning to FIG. 1, the emergency respondence warning system 10 of the present invention is also operable when two or more emergency vehicles are approaching the intersection 12. For example, vehicle 14A and 14B are approaching intersection 12 at approximately the same time, as shown in FIG. 1. Vehicle 14A holds transmitter 18A, and vehicle 14B holds transmitter 18B. Each vehicle is traveling at a different speed toward the intersection 12 and is located a different distance from the receiver 20A. In the operation of the present invention, receiver 20A will simultaneously receive and translate signals from the transmitter 18A of vehicle 14A, and transmitter 18B vehicle 14B will send a signal from transmitter 18B to receiver 20A. The receiver 20A analyzes the distance and direction of travel of both vehicles 14A and 14B based upon their distance and velocity as the vehicles approach the intersection 12. The receiver 20A then determines that two vehicles are approaching the intersection and activates the warning element 62A. In one embodiment of the invention, the warning element 62A is a stroboscopic light that emits a single pulse when only one vehicle 14A is approaching the intersection and a double pulse when more than one vehicle 14A and 14B are approaching the intersection.

When multiple receivers are employed at the roadway intersection 12, then all of the receivers 20A-20D respond similarly to the approach of emergency vehicle 14A. The transmitter 18A of vehicle 14A and transmitter 18B of vehicle 14B each broadcast signals which are detected by all receivers 20A-20D at the intersection 12, and each receiver processes these signals according to the protocol programmed into the processor 38B associated with each receiver. It will be appreciated that when multiple receivers 20A-20D and multiple warning elements 62A-62D are mounted at the intersection 12, all warning elements will emit a single pulse as one vehicle 14A approaches but will emit a double pulse, or other differentiated signal, when multiple vehicles are approaching the intersection.

Figure 6:
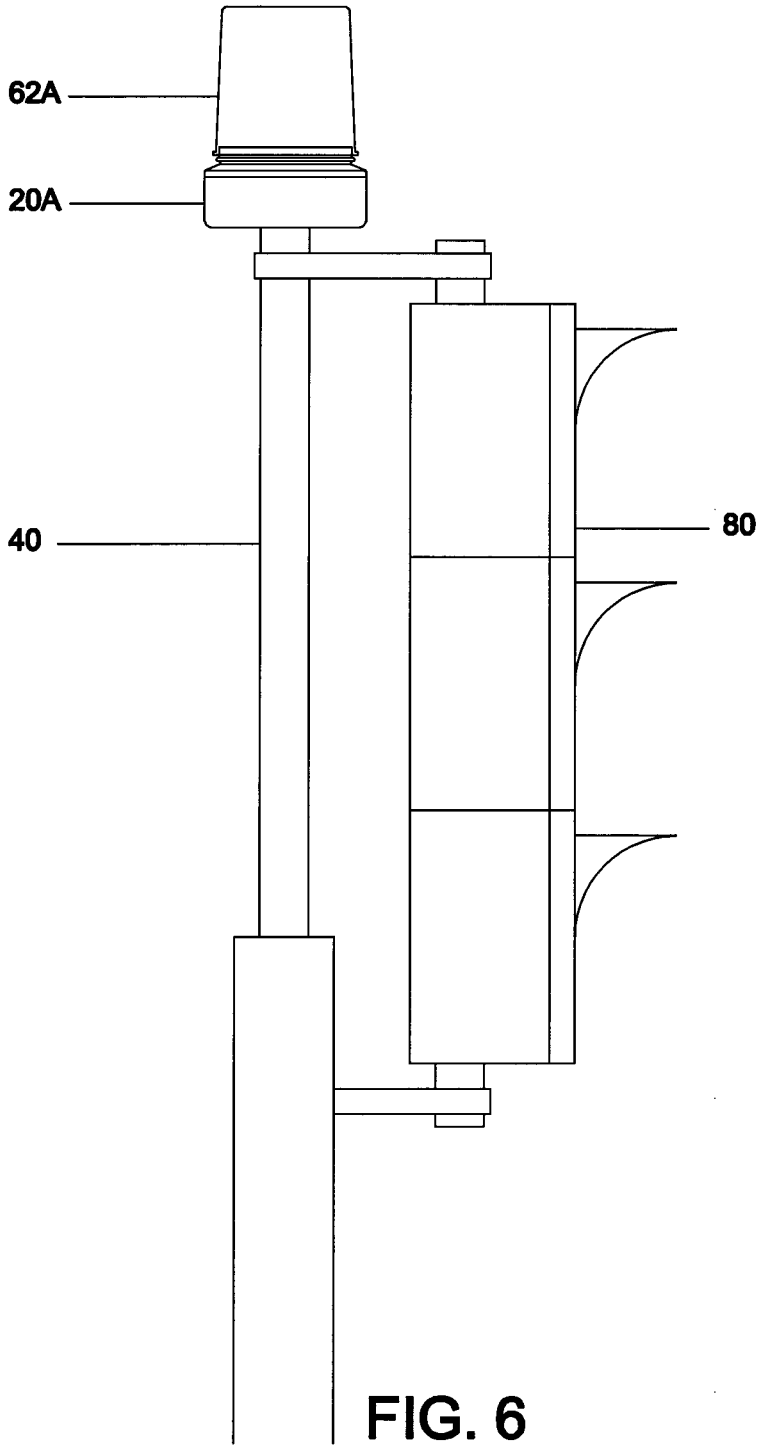
FIG. 6 illustrates an alternative for mounting the receiver and warning element to a vertical light pole at a roadway intersection.
Figure 7:
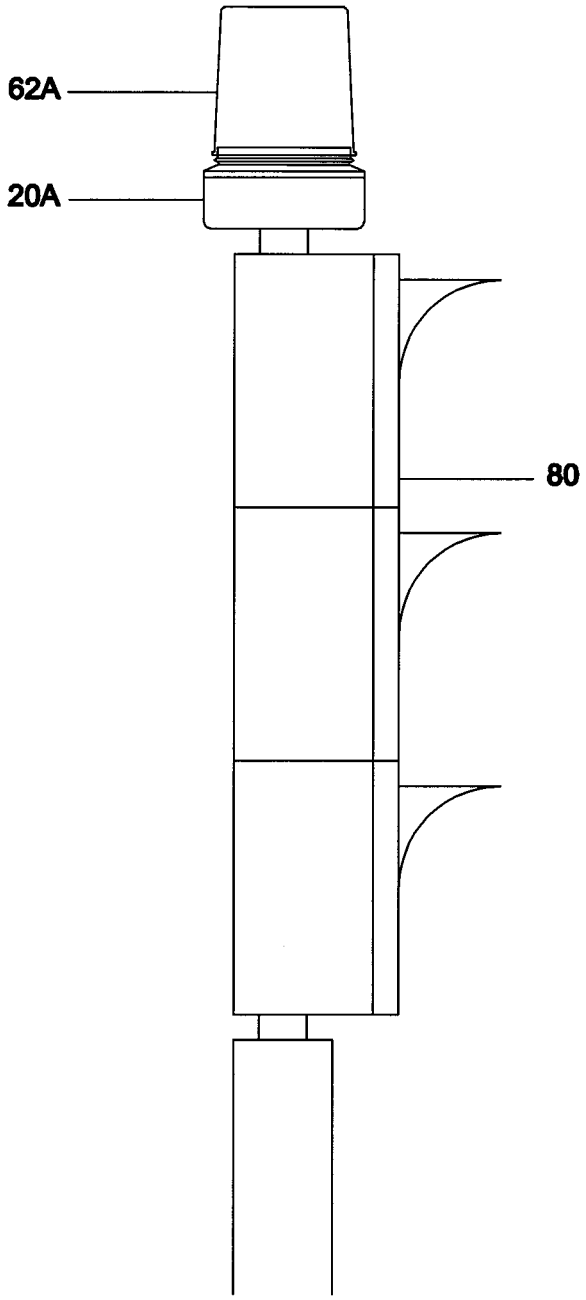
FIG. 7 illustrates an alternative for mounting the receiver and warning element to a vertical light pole at a roadway intersection.
Figure 8:
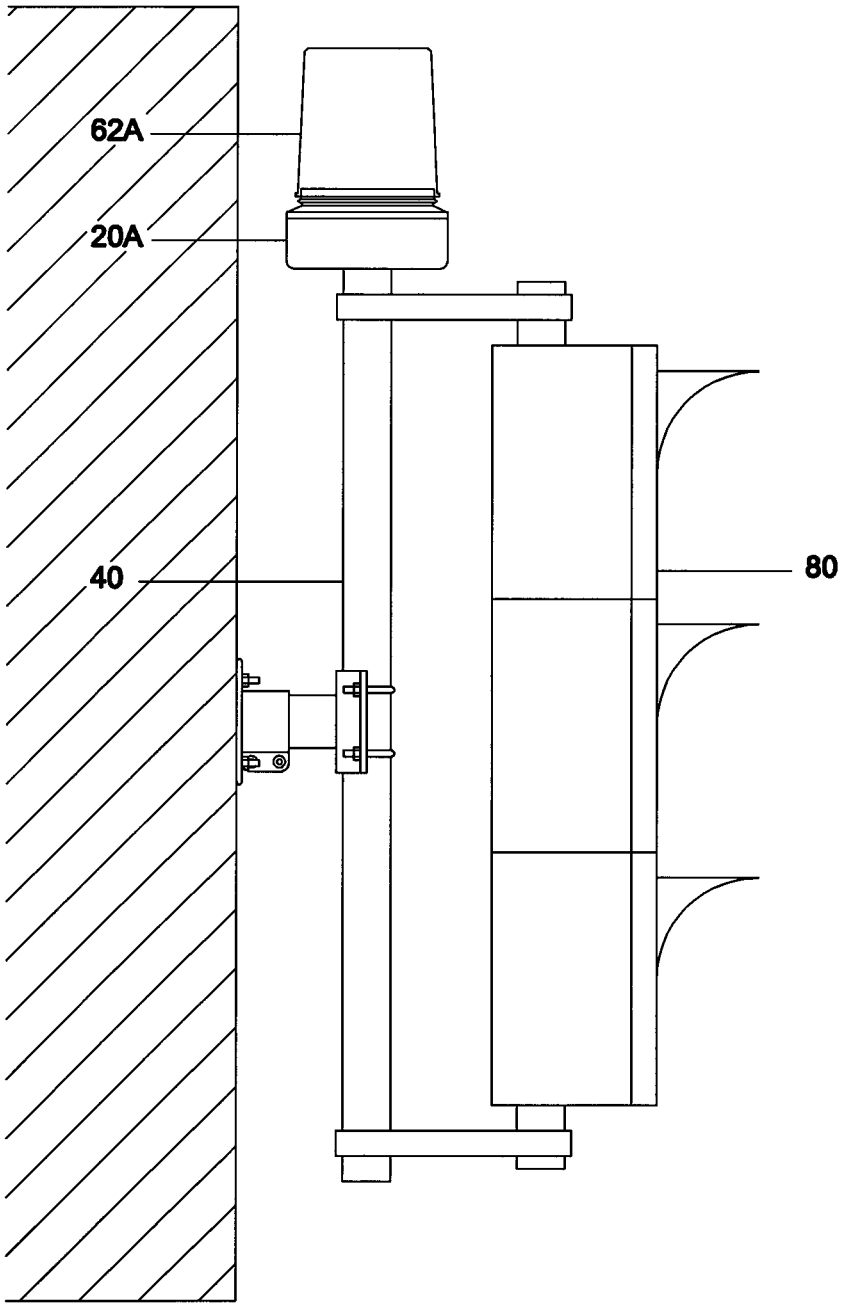
FIG. 8 illustrates an alternative for mounting the receiver to a roadway light mounted on a building.
Figure 9:
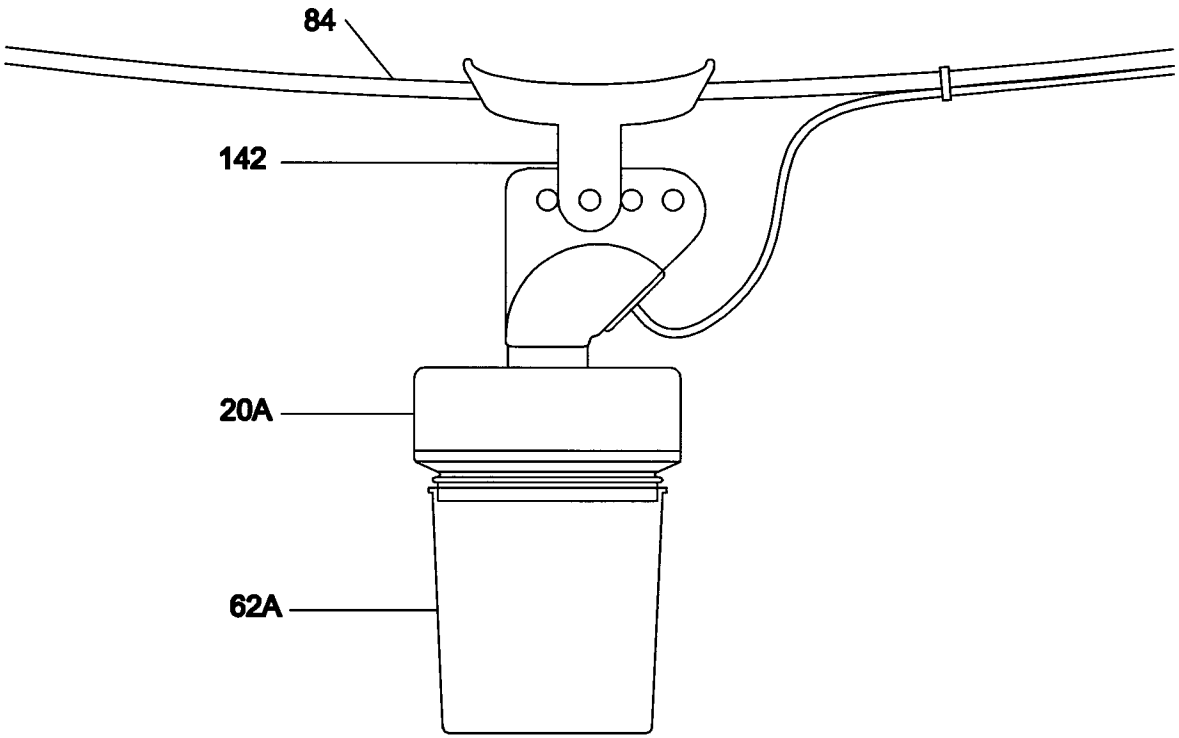
FIG. 9 illustrates an alternative for mounting the receiver to a light cable at a roadway intersection.

It will be appreciated that the receiver 20A and warning element 62A may be located near the roadway intersection 12 by any number of means, including attachment to signal light poles, cables and buildings. FIG. 6 demonstrates the receiver 20A and warning element 62A mounted on support 40 behind the light signal 80 on a vertical pole used at the side of an intersection, rather than mounted on a horizontal pole over the roadway as shown in FIG. 1. FIG. 7 shows receiver 20A and warning element 62A mounted vertically in the same plane as the signal 30 on a vertical light pole. Additionally, the receiver 20A and warning element 62A may be mounted on a building as shown in FIG. 8. And, in those instances where the light signal is suspended from a cable 84 overhanging an intersection, the receiver 20A and warning element 62A are suspended from the cable 84 by an appropriate mounting assembly 142.

Figure 10:
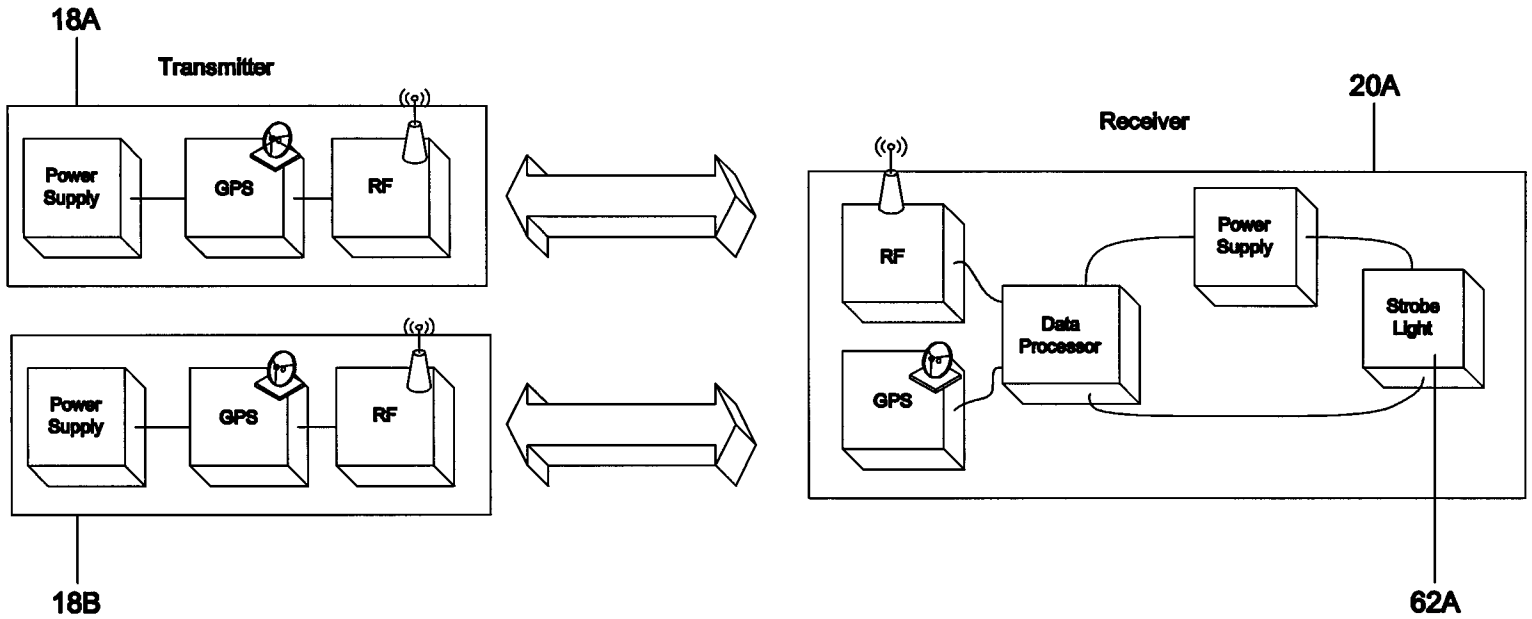
FIG. 10 is a schematic diagram showing an exemplary electronic information flow according to the emergency respondence warning system of the present invention.
Figure 11:
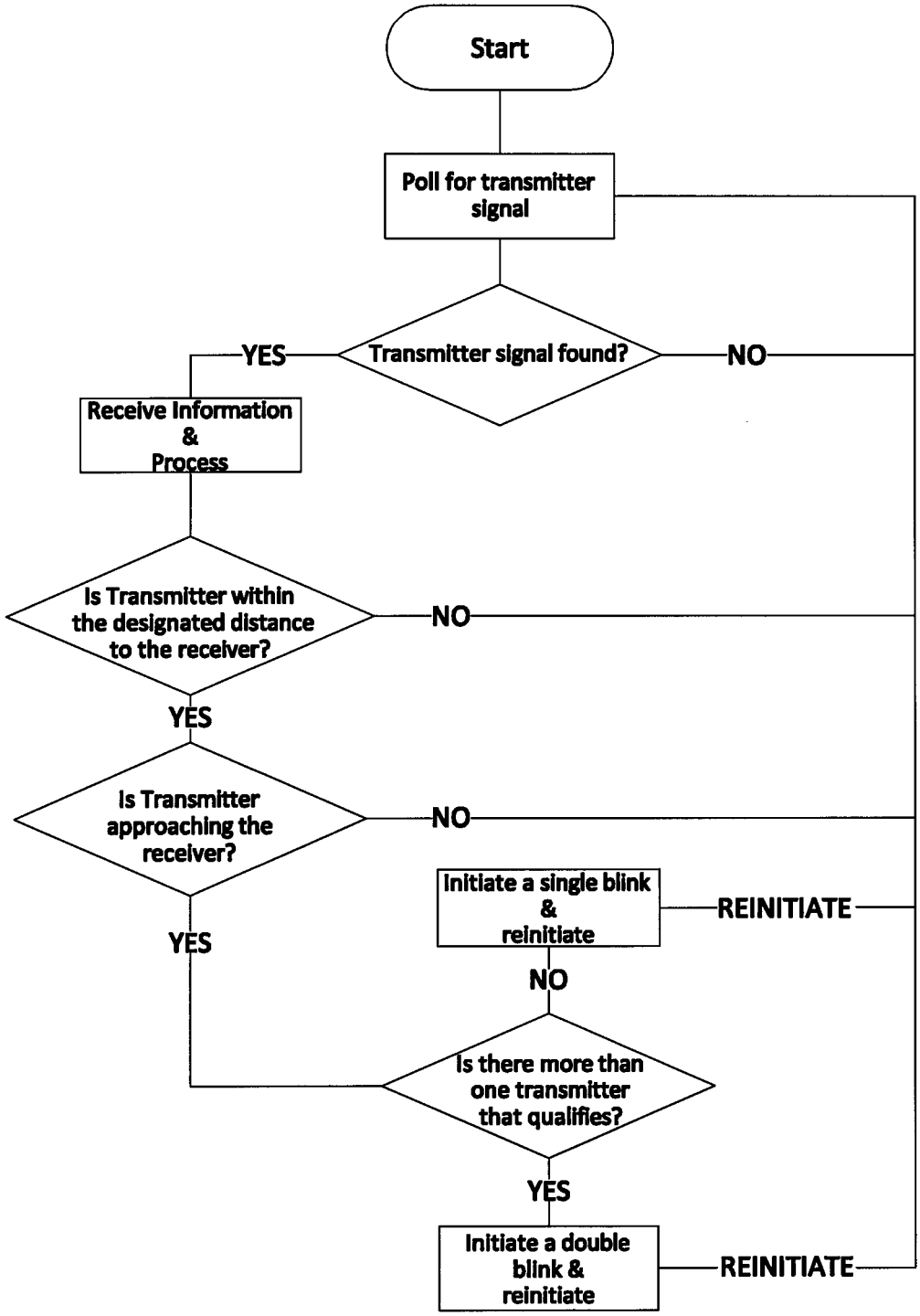
FIG. 11 is a sample flowchart for software that may be used to operate the emergency respondence warning system of the present invention.

An example of data communication flow between transmitters 18A and 18B to receiver 20A is shown in FIG. 10, while an example of software logic flow is shown in the flow chart in FIG. 11. The software installed on processor 38B begins by searching for a signal from a transmitter. When a signal is found, the processor 38B calculates whether the transmitter is within a designated distance from the receiver 20A, in association with the positioning data provided by the GPS chips 34A and 34B and the RF chips 36A and 36B. If the transmitter is within a pres-designated distance, then the software determines whether the transmitter is approaching the receiver 20A or traveling away from the receiver. If the former, then the software protocol then determines whether a single transmitter is approaching or multiple transmitters are approaching. For a single transmitter, the processor instructs the warning element to initiate a single flash and for multiple transmitters approaching the receiver, a double flash of light. If the transmitters are traveling away from the receiver, the software instructs the processor to reinitiate the process.

With continuing reference to FIGS. 1, 10 and 11, the method of the present invention is described and incorporates in its entirety the foregoing description of the emergency vehicle warning system 10. The method comprises the steps of transmitting a signal from an emergency vehicle 14A to a receiver 20A mountable at a roadway intersection 12. The receiver analyzes the signal from the transmitter 18A to determine whether the vehicle 14A is within a pre-determined distance and direction of travel in any direction towards the receiver 20A. The receiver 20A also analyzes the signal to determine whether the emergency vehicle 14A is traveling toward the receiver. Once the emergency vehicle passes through the intersection, the receiver 20A interprets the transmission as moving away from the receiver and ceases protocol.

Whenever the power source to the transmitter 18A is turned on, the RF-GPS tracking system 30A continuously or intermittently sends signals broadcasting the position information of the vehicle 14A, which the receiver 20A interprets as distance traveled, length of time traveled, current speed, average speed, path of travel and estimated time of arrival at destination, if current speed is maintained, among other things. When the transmitter 18A is activated, it will send information from the GPS-RF system 30A to the receiver 20A at a rate of several times per second. With that information, the receiver 20A will calculate the speed, distance, and direction of travel of the transmitter 18A and whether the emergency vehicle 14A is within a predetermined distance and traveling towards the receiver. As the emergency vehicle 14A approaches the intersection 12, the transmitter 18A broadcasts its GPS location which is then picked up by the receiver 20A.

The receiver 20A detects and analyzes the broadcast location of transmitter 18A with reference to its own location and determines distance, direction and speed of the vehicle 14A. Receiver 20A may determine a distance and a direction of the emergency vehicle 14A in any direction of travel with respect to the receiver. For example, if emergency vehicle 14A is traveling along path of travel A shown in FIG. 1, transmitter 18A mounted atop vehicle 14A or inside vehicle 14A sends a signal to receiver 20A. Receiver 20A analyzes the signal and determines speed, distance, and direction of travel of the emergency vehicle 14A and whether the vehicle is within a predetermined distance of and traveling towards the receiver.

The method further comprises a step of issuing a warning when the emergency vehicle 14A reaches a pre-determined distance from the receiver 20A. The receiver 20A will activate the warning signal 62A when the emergency vehicle 14A is within a travel time of at between 10 to 20 seconds away from the receiver. In one method of the invention, the receiver will activate the warning element when the emergency vehicle is about 15 seconds away from the receiver. In one method of the invention, the warning element emits flashes of stroboscopic light.

The method of the present invention further comprises the step of simultaneously transmitting signals from a plurality of emergency vehicles 14A and 14B to the receiver 20A. The receiver 20A activates the warning element 62A but instructs the warning signal to emit a unique signal when a plurality of emergency vehicles 14A and 14B reach a pre-determined distance from the receiver. In one embodiment of the invention, the warning element produces a double pulse from a stroboscopic light when a plurality of emergency vehicles approach the intersection and a single pulse otherwise.

It now will be appreciated that the subject invention is an economical and effective means of individualized control to mitigate the risk of collision with emergency vehicles through roadway intersections. The present invention provides a visual emergency respondence warning system that is separate from and operated independently of a central controller and that provides visual stimuli for other drivers and pedestrians. The present invention overcomes difficulties associated with conventional emergency respondence warning systems and provides an efficient and cost effective method for alerting others of the approach of emergency vehicles.

The invention of this application has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. An emergency respondence warning system, comprising:

a transmitter mountable to an emergency vehicle, the transmitter comprising a global positioning chip and capable of producing a signal;

a receiver mountable near a roadway intersection, the receiver comprising a global positioning chip, wherein the receiver is capable of analyzing the signal from the transmitter as the transmitter approaches the receiver and, when the transmitter reaches a pre-determined distance from the receiver, of activating the warning system; and a warning element comprising a visual light stimulus, the warning element mountable near the roadway intersection and adapted to produce a single light pulse when a single transmitter is approaching the roadway intersection and multiple light pulses when multiple transmitters are approaching the roadway intersection.

2. The emergency respondence warning system of claim 1, wherein the warning element produces the warning signal when the emergency vehicle is between about 10 to 20 seconds away from the receiver.

3. The emergency respondence warning system of claim 1, wherein the warning element produces the warning signal when the emergency vehicle is about 15 seconds away from the receiver as determined by comparison of the global positioning chip of the transmitter and the global positioning chip of the receiver.

4. The emergency respondence warning system of claim 1, further comprising a power source at the roadway intersection and wherein the power source supplies power to both the intersection and to the receiver.

5. The emergency respondence warning system of claim 1, further comprising a receiver power source, wherein the receiver power source comprises a battery with solar power backup.

6. The emergency respondence warning system of claim 1, wherein the emergency vehicle comprises an electrical lighting system and wherein the transmitter is powered by the emergency vehicle electrical lighting system.

7. The emergency respondence warning system of claim 1, further comprising a plurality of transmitters each of which is capable of producing a signal and is mountable to an individual emergency vehicle, wherein the receiver is capable of receiving a plurality of signals from the plurality of transmitters and substantially simultaneously analyzing the plurality of signals to determine a distance and a direction in any direction of travel of each emergency vehicle with respect to the receiver.

8. The emergency respondence warning system of claim 7, further comprising a plurality of a warning elements mountable near at the roadway intersection, wherein each of the plurality of warning elements is adapted to produce a differentiated warning signal when multiple transmitters are approaching the roadway intersection and a differentiated warning signal when only one transmitter is approaching the roadway intersection.

9. The emergency respondence warning system of claim 7, wherein the receiver is adapted to activate the warning element as the plurality of transmitters approach the receiver.

10. The emergency respondence warning system of claim 1, wherein the transmitter further comprises a radio frequency chip and a processor.

11. The emergency respondence warning system of claim 1, wherein the receiver further comprises a radio frequency chip and a processor.

12. The emergency respondence warning system of claim 1, wherein the receiver is mounted within 250 feet of the roadway intersection.

13. The emergency respondence warning system of claim 1, wherein the receiver is mounted on a light pole overhanging the roadway intersection.

14. The emergency respondence warning system of claim 1, wherein the receiver is mounted on a lightpole at the side of roadway intersection.

15. The emergency respondence warning system of claim 1, wherein the receiver is mounted on a building near the roadway intersection.

16. The emergency respondence warning system of claim 1, wherein the receiver is mounted on a cable overhanging the intersection.

17. The emergency respondence warning system of claim 11, wherein the receiver further comprises switches for activating a speed limit corresponding to the speed limit at the intersection.

18. A method of warning of the approach of emergency vehicles at a roadway intersection, the method comprising the steps of:

transmitting a signal from an approaching emergency vehicle to a receiver comprising a global receiver mountable near the roadway intersection;

analyzing the signal to determine whether the transmitter is traveling toward the receiver and whether the transmitter is within a predetermined distance from the receiver and with respect to any direction of travel thereto;

activating a warning element when the transmitter reaches a pre-determined distance from the receiver by producing a single pulse of light when a single transmitter is approaching the roadway intersection and multiple pulses of light when multiple transmitters are approaching the roadway intersection.

19. The method of claim 18 further comprising the step of issuing a warning when the emergency vehicle is between about 10 to 20 seconds away from the receiver.

20. The method of claim 18 further comprising the step of issuing a warning when the emergency vehicle is about 15 seconds from the receiver.

21. The method of claim 18 further comprising the step of transmitting signals from a plurality of emergency vehicles to the receiver.

22. The method of claim 21 further comprising the step of issuing a differentiated warning signal when a plurality of emergency vehicles reach a predetermined distance from the receiver.

23. The method of claim 18 further comprising the steps of transmitting signals from a plurality of approaching emergency vehicles to a plurality of receivers mountable near the roadway intersection;

analyzing the signals to determine whether the emergency vehicles are within a predetermined distance from the receivers and with respect to any direction of travel thereto; and analyzing the signals to determine whether the emergency vehicles are traveling toward the receiver.

* * * * *